US007909452B2

(12) United States Patent
Yamashita et al.

(10) Patent No.: US 7,909,452 B2
(45) Date of Patent: Mar. 22, 2011

(54) RECORDING APPARATUS AND RECORDING MATERIAL

(75) Inventors: Yoshiro Yamashita, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 435 days.

(21) Appl. No.: 12/051,934

(22) Filed: Mar. 20, 2008

(65) Prior Publication Data

US 2009/0079807 A1 Mar. 26, 2009

(30) Foreign Application Priority Data

Sep. 20, 2007 (JP) ..... 2007-244208

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 6,460,957 B1 * 10/2002 Quintens et al. ..... 347/2
2005/0270351 A1 12/2005 Mouri et al.
2007/0165088 A1 * 7/2007 Maeno et al. ..... 347/100
2007/0195133 A1 * 8/2007 Igarashi et al. ..... 347/71
2007/0211128 A1 * 9/2007 Parker et al. ..... 347/103

FOREIGN PATENT DOCUMENTS

| | | |
|---|---|---|
| JP | 11-188858 | 7/1999 |
| JP | 2000-94654 | 4/2000 |
| JP | 2000-343808 | 12/2000 |
| JP | 2001-212956 | 8/2001 |
| JP | 2001-315426 | 11/2001 |
| JP | 2002-187240 | 7/2002 |
| JP | 2002-283555 | 10/2002 |
| JP | 2002-321443 | 11/2002 |
| JP | 2002-370347 | 12/2002 |
| JP | 2003-57967 | 2/2003 |
| JP | 2005-170036 | 6/2005 |
| JP | 2007-230232 | 9/2007 |

* cited by examiner

*Primary Examiner* — Stephen D Meier
*Assistant Examiner* — Alexander C Witkowski
(74) *Attorney, Agent, or Firm* — Fildes & Outland, P.C.

(57) ABSTRACT

A recording apparatus includes an intermediate transfer member, a supply unit that supplies onto the intermediate transfer member a curable solution containing a cationic curable material that is cured by a cationic curing reaction upon application of an external stimulus, a discharge unit that discharges an ink containing a recording substance to a layer to be cured that has been formed by the curable solution supplied onto the intermediate transfer member, a transfer unit that transfers, from the intermediate transfer member to a recording medium, the layer to be cured to which the ink is discharged, and a stimulus supply unit that supplies a stimulus that cures the layer to be cured.

15 Claims, 3 Drawing Sheets

RECORDING APPARATUS AND RECORDING MATERIAL

CROSS-REFERENCE TO RELATED APPLICATION

This application is based on and claims priority under 35 USC 119 from Japanese patent Application No. 2007-244209 filed on Sep. 20, 2007.

BACKGROUND

1. Technical Field

The present invention concerns a recording apparatus and a material for recording.

2. Related Art

Methods for recording an image or data by using ink include an ink jet recording method. The principle of the ink jet recording method is to discharge a liquid or molten solid ink from a nozzle, slit, porous film, or the like to conduct recording on paper, cloth, film or the like. As a method of discharging the ink, there have been proposed various methods, for example, a so-called charge control method of discharging ink by using an electrostatic attraction force, a so-called drop on demand method (pressure pulse method) of discharging ink by using a vibration pressure of a piezo device, and a so-called thermal ink jet method of discharging ink by using a pressure caused by forming and growing bubbles by intense heat, and recorded products of very high definition images or data can be obtained by the methods.

In the field of recording methods that use the ink including the ink jet recording method, a method has been proposed in which transfer to a recording medium is conducted after recording on an intermediate transfer member so as to allow high image quality recording on various recording media such as pervious media and impervious media.

SUMMARY

According to an aspect of the invention, there is provided a recording apparatus including;

an intermediate transfer member, a supply unit that supplies onto the intermediate transfer member a curable solution containing a cationic curable material that is cured by a cationic curing reaction upon application of an external stimulus, a discharge unit that discharges an ink containing a recording substance to a layer to be cured that has been formed by the curable solution supplied onto the intermediate transfer member, a transfer unit that transfers, from the intermediate transfer member to a recording medium, the layer to be cured to which the ink is discharged, and a stimulus supply unit that supplies a stimulus that cure the layer to be cured.

BRIEF DESCRIPTION OF THE DRAWINGS

Exemplary embodiments of the present invention will be described in detail based on the following figures, wherein.

DETAILED DESCRIPTION

Figure 1:
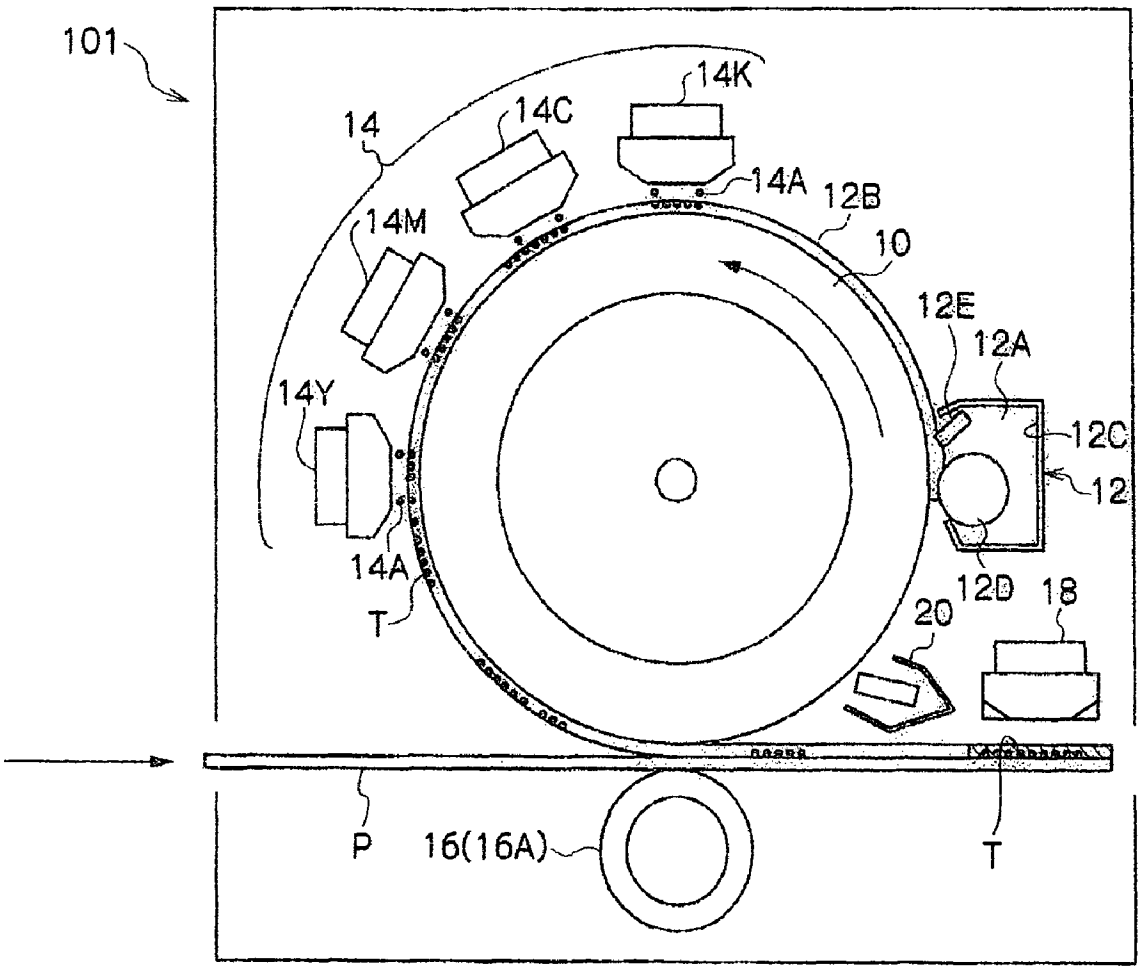
FIG. 1 is a constitutional view showing a recording apparatus according to a first exemplary embodiment.

Exemplary embodiments of the present invention are to be described with reference to the drawings. Throughout the drawings, those members having substantially identical functions carry same reference characters, and duplicated descriptions thereon are sometimes omitted.

First Exemplary Embodiment

FIG. 1 is a constitutional view showing a recording apparatus according to a first exemplary embodiment.

A recording apparatus 101 according to a first exemplary embodiment includes, for example as shown in FIG. 1, an intermediate transfer drum 10, a solution supply device 12 that supplies a curable solution, 12A containing a cationic curable material that is cured by a cationic curing reaction upon application of an external stimulus (energy) (hereinafter sometimes referred to as a curing material) onto the intermediate transfer drum 10 to form a layer 12B to be cured that is formed by the curable solution 12A, an inkjet recording head 14 that discharges ink droplets 14A onto a layer 12B to be cured so as to form an image T, a transfer device 16 that places a recording medium P on the intermediate transfer drum 10 and transfers, by application of pressure, the layer 12B to be cured having an image T formed thereon to the recording medium P, and a stimulus supply device 18 that supplies a stimulus that cures the layer 12B to be cured that was transferred to the recording medium P.

Further, a cleaning device 20 that removes residues of the layer 12B to be cured remaining on the surface of the intermediate transfer drum 10 and removes adhered matters such as foreign matters (paper dusts of recording medium P and the like) other than the residues is disposed at the downstream of the transfer device 16 with respect to the rotational direction of the intermediate transfer drum 10.

The intermediate transfer drum 10 may have, for example, a constitution having a cylindrical substrate and a surface layer coated on a surface of the substrate. The intermediate transfer drum 10 has a width (length in its axial direction) that is equal to or larger than the width of the recording medium P.

Examples of the material for the cylindrical substrate include aluminum, stainless steel (SUS), and copper.

Examples of the material for the surface layer include various kinds of resin (for example, polyimide, polyamide-imide, polyester, polyurethane, polyamide, polyether sulfone, and fluorine-containing resin, etc.), and various kinds of rubber (for example, nitrile rubber, ethylene propylene rubber, chloroprene rubber, isoprene rubber, styrene rubber, butadiene rubber, butyl rubber, chlorosulfonated polyethylene, urethane rubber, epichlorohydrin rubber, acryl rubber, silicone rubber, and fluorine rubber). The surface layer may have a single-layered constitution or a multi-layered constitution.

The solution supply device 12 includes, for example, in a casing 12C containing a curable solution 12A, a supply roller 12D that supplies the curable solution 12A to the intermediate transfer drum 10, and a blade 12E that determines the thickness of the layer 12B to be cured that is formed by the supplied curable solution 12A.

The solution supply device 12 may have a constitution in which the supply roller 12D is in continuous contact with the intermediate transfer drum 10 or may have a constitution in which the roller 12D is apart from the intermediate transfer drum 10. Further, the solution supply device 12 may have a constitution in which interruption of the supply of the curable solution 12A is prevented by supply of the curable solution 12A from an independent solution supply method (not illustrated) to the casing 12C.

The curable solution 12A corresponds to the recording material according to an exemplary embodiment of the invention. Further, "cationic curable material that is cured by a cationic curing reaction upon application of an external stimulus (energy)" contained in the curable solution 12A means a material that is cured by a cationic curing reaction upon application an external stimulus to become a "cationically cured resin". Specifically, examples of the material include cationic curable monomers, cationic curable macromers, cationic curable oligomers, cationic curable prepolymers, etc. Details thereof will be described later.

The solution supply device 12 is not restricted to the constitution described above, and devices using known supply methods (e.g., coating methods such as bar coater coating, spray coating, ink jet coating, air knife coating, blade coating, roll coating, etc.) are also applicable.

The ink jet recording head 14 includes, for example, recording heads for respective colors—a recording head 14K for discharging a black ink, a recording head 14C for discharging a cyan ink, a recording head 14M for discharging a magenta ink, and a recording head 14Y for discharging a yellow ink disposed in this order from the upstream side in the rotational direction of the intermediate transfer drum 10.

The constitution of the recording head 14 is not restricted to the structure described above; the recording head 14 may have only the recording head 14K, or may have only the recording head 14C, the recording head 14M, and the recording head 14Y.

Each recording head 14 may be, for example, a line type ink jet recording head having a width that is equal to or larger than that of the recording medium P. However, an ink jet recording head of an existent scanning type is also usable. The ink discharge method of each recording head 14 is not restricted so long as it is a method capable of discharging ink, and examples thereof include a piezo electric device driving type, a heat generation device driving type, etc.

Respective recording heads 14 are arranged, for example, in series in the order of the recording head 14K, the recording head 14C, the recording head 14M, and the recording head 14Y from the upstream side in the rotational direction of the intermediate transfer drum 10.

Each recording head 14 is arranged with a distance between the surface of the intermediate transfer drum 10 and the nozzle surface of the head, for example, of about 0.3 to about 0.7 nm. Further, each recording head 14 is disposed, for example, with the longitudinal direction thereof intersecting (for example, at a right angle) with the rotational direction of the intermediate transfer drum.

The transfer device 16 includes a pressure roll 16A disposed to be pressed against the intermediate transfer drum 10. The pressure roll 16A has, for example, the same material constitution as that of the intermediate transfer drum 10.

The stimulus supply device 18 is selected in accordance with the kind of the curable material contained in the curable solution 12A to be applied. Specifically, when applying a cationic UV curable material that is cured by a cationic curing reaction under the irradiation of UV-rays (hereinafter sometimes referred to simply as "UV curable material", for example, a UV irradiation device that irradiates UV-rays to the curable solution 12A (layer 12B to be cured that has been formed therewith) may be used as the stimulus supply device 18. Further, when applying a cationic electron beam curable material that is cured by a cationic curing reaction under the irradiation of an electron beam (hereinafter sometimes referred to simply as "electron beam curable material"), an electron beam irradiation device that irradiates an electron beam to the curable solution 12A (layer 12B to be cured that has been formed therewith) may be used as the stimulus supply device 18. Further, when applying a cationic heat-energy curable material that is cured by a cationic curing reaction under heating (hereinafter may sometimes referred to simply as "heat curable material", a heating device that supplies heat to the layer 12A (layer 12B to be cured that has been formed therewith) may be used as the stimulus supply device 18.

UV irradiation devices applicable herein include, for example, a metal halide lamp, a high pressure mercury lamp, an ultra high pressure mercury lamp, a deep UV-ray lamp, a lamp in which a mercury lamp is excited, without electrodes, from the outside by using microwaves, a UV laser, a xenon lamp, a UV-LED, etc.

The irradiation conditions of the UV-rays are not particularly restricted so long as the conditions allows the curable solution 12A containing the UV curable material (layer 12B to be cured that has been formed therewith) to be cured sufficiently, and the conditions may be selected in accordance with the UV irradiation position, the species of the UV curable material, the thickness of the layer 12B to be cured, etc. For example, the conditions may be irradiation for 2 sec by a high pressure mercury lamp at 120 W/cm.

Further, electron beam irradiation devices include, for example, a scanning type, a curtain type, etc. The curtain type electron beam irradiation device is a device in which thermal electrons generated at a filament are extracted by a grid in a vacuum chamber, and are accelerated at once by a high voltage (for example, from 70 to 300 kV) to form an electron stream, and the electrons are discharged through a window foil to the atmosphere. The wavelength of the electron beam is generally shorter than 1 nm and its energy may be as high as several MeV. For example, an electron beam at a wavelength number of pm order with an energy of several tens to several hundreds KeV may be applied.

Irradiation conditions for the electron beam are not particularly restricted so long as the conditions allow the curable solution 12A containing the electron beam curable material (layer 12B to be cured that has been formed therewith) to be sufficiently cured, and the conditions may be selected in accordance with the electron beam irradiation position, the species of the electron beam curable material, the thickness of the layer 12B to be cured, etc. For example, the electron beam dose may be at a level of from 5 to 100 kGy.

The "sufficiently cured state" means a state where transfer does not occur when 200 g load is applied after pervious paper (plain paper) is placed on the cured layer obtained by curing, with the stimulus supply device 18, the layer 12B to be cured.

As the recording medium P, any of pervious media (for example, plain paper or coated paper) or impervious media (for example, art paper or resin film) may be applied. The recording medium is not restricted to them; the recording medium may be an industrial product such as a semiconductor substrate.

The image recording process in the recording apparatus 101 according to this exemplary embodiment is described below.

In the recording apparatus 101 according to the exemplary embodiment, the intermediate transfer drum 10 is rotationally driven and, first, the curable solution 12A is supplied to the surface of the intermediate transfer drum 10 by the solution supply device 12 to form the layer 12B to be cured.

While the thickness of the layer 12B to be cured is not particularly restricted, it is, for example, within a range of 1

μm to 50 μm, preferably, 2 μm to 20 μm and, more preferably, 3 μm to 10 μm. Further, it is possible to control the thickness of the layer 12B to be cured such that the layer thickness is set to a minimum required thickness (for example, from 1 to 5 μm) when the image density is low (applied ink amount is small (for example, from 0.1 to 1.5 $g/m^2$)), and such that the thickness is set, for example, to the range of 4 to 10 μm when the image density is high (applied ink amount is large (for example, from 4 to 15 $g/m^2$)).

Further, when the thickness of the layer 122B to be cured is set to such a thickness that the ink droplets 14A do not reach the lowermost layer of the layer 122B to be cured, a region in the layer 12B to be cured where the ink droplets 14A are present is not exposed after the transfer to the recording medium P, and the region where the ink droplets 14A are not present functions as a protection layer after curing.

Then, the ink droplets 14A are discharged by the ink jet recording head 14 and the ink droplets 14A are provided to the layer 12B to be cured that was supplied onto the intermediate transfer drum 10. The ink jet recording head 14 provides the ink droplets 14A to a predetermined position of the layer 12B to be cured based on predetermined image information.

When providing the ink droplets 14A, the ink droplets 14A is discharged by the ink jet recording head 14 onto the intermediate transfer drum 10, which is a rigid body. That is, the ink droplets 14A are discharged to the layer 12B to be cured in a state where the drum surface is not distorted.

Then, by allowing the recording medium P to be nipped between the transfer device 16 and the intermediate transfer drum 10 and applying a pressure to the layer 12B to be cured, the layer 12B to be cured having an image formed by the ink droplets 14A is transferred to the recording medium P.

Then, when the layer 12B to be cured is cured by the stimulus supply device 18, image T formed by the ink droplets 14A is fixed on the recording medium P by the cationic curable resin. In this way, a cationic curable resin layer containing the image T formed by the ink, droplets 14A (image layer) is formed on the recording medium P.

Then, residues of the layer 12B to be cured or foreign matters left on the surface of the intermediate transfer drum 10 after the transfer of the layer 12B to be cured to the recording medium P are removed by the cleaning device 20, and the curable solution 12A is supplied again by the solution supply device 12 onto the intermediate transfer drum 10 to form the layer 12B to be cured, whereby the image recording process is repeated.

In the manner described above, image recording is conducted in the recording apparatus 101 according to this exemplary embodiment.

Second Exemplary Embodiment

Figure 2:
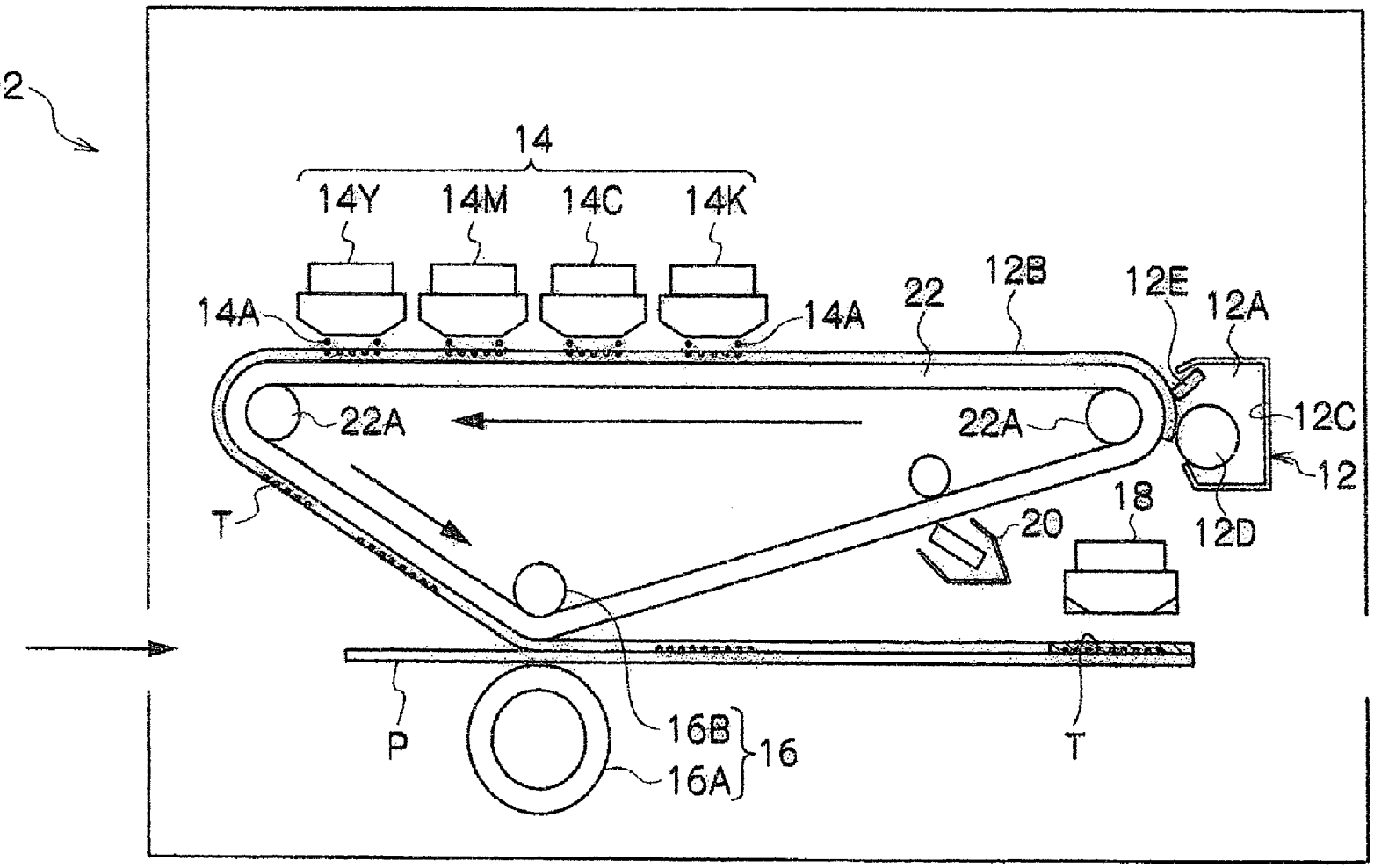
FIG. 2 is a constitutional view showing a recording apparatus according to a second exemplary embodiment.

FIG. 2 is a constitutional view showing a recording apparatus according to a second exemplary embodiment.

The recording apparatus 102 according to the second exemplary embodiment is in a form, as shown in FIG. 2, in which an intermediate transfer belt 22 is disposed instead of the intermediate transfer drum 10 in the first exemplary embodiment.

The intermediate transfer belt 22 is disposed, for example, in the state of being rotatably supported while tension is applied from its inner circumferential surface side by two support rolls 22A and a pressure roll 16B (transfer device 16).

The intermediate transfer belt 22 has a width (length in the axial direction) that is equal to or larger than the width of the recording medium P.

The intermediate transfer belt 22 includes, for example, one or more selected from various kinds of resin (for example, polyimide, polyamideimide, polyester, polyurethane, polyamide, polyether sulfone, fluorine-containing resin, etc.), and various kinds of rubber (for example, nitrile rubber, ethylene propylene rubber, chloroprene rubber, isoprene rubber, styrene rubber, butadiene rubber, butyl rubber, chlorosulfonated polyethylene, urethane rubber, epichlorohydrin rubber, acryl rubber, silicone rubber, and fluorine rubber).

As an alternative, the intermediate transfer belt 22 may include a metal material such as stainless steel. The intermediate transfer belt 22 may have a single-layered structure or a multi-layered structure. Further, the intermediate transfer belt 22 may have a surface layer made of a release material such as a fluororesin or silicone rubber.

Each recording head 14 is disposed to face a non-curving region on the rotatably supported intermediate transfer belt under tension, with a distance between the surface of the intermediate transfer belt 22 and the nozzle surface of the head, for example, of about 0.7 to about 1.5 nm.

The transfer device 16 includes a pair of pressure rolls (16A and 16B) with the intermediate transfer belt 22 nipped therebetween.

In the recording apparatus 102 according to this exemplary embodiment, the ink droplets 14A are discharged by the ink jet recording head 14 and the ink droplets 14A are provided to the layer 12B to be cured that has been formed on the intermediate transfer belt 22.

When providing the ink droplets 14A, the ink droplets 14A are discharged by the ink jet recording head 14 onto the non-curving region on the rotatably supported intermediate transfer belt 22 under tension. That is, the ink droplets 14A are discharged to the layer 12B to be cured in the state where the belt surface is not distorted.

Since the elements and constitutions shown by the other references than those described above are the same as those in the first exemplary embodiment, descriptions thereof are omitted.

Third Exemplary Embodiment

Figure 3:
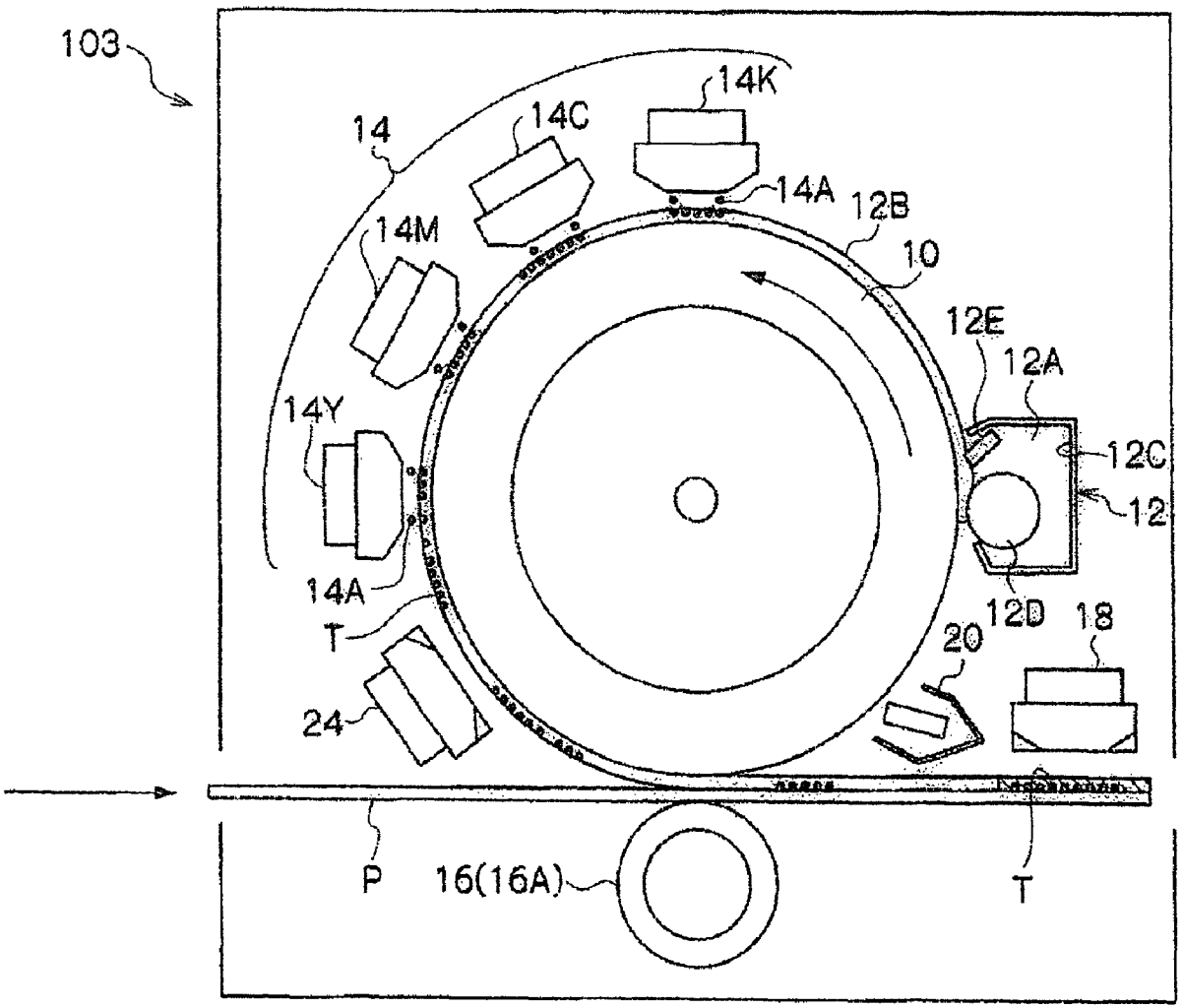
FIG. 3 is a constitutional view showing a recording apparatus according to a third exemplary embodiment.

FIG. 3 is a constitutional view showing a recording apparatus according to a third exemplary embodiment.

As shown in FIG. 3, in the recording apparatus 103 according to the third exemplary embodiment, a second stimulus supply device 24 is additionally disposed in the first exemplary embodiment, and the second stimulus supply device supplies a stimulus that semi-cures the layer 12B to be cured before the layer 12B to be cured having an image formed by the ink droplets 14A is transferred to the recording medium P.

The second stimulus supply device 24 is disposed, for example, at the downstream side of the ink jet recording head 14 but at the upstream side of the transfer device 16, with respect to the rotational direction of the intermediate transfer drum 10.

The second stimulus supply device 24 is selected in accordance with the kind of the curable material contained in the curable solution. 12A to be applied, similarly to the stimulus supply device 18. Specifically, when applying a UV curable material, a UV irradiation device that irradiates UV-rays to the curable solution 12A (layer 12B to be cured that has been formed therewith) may be used as the second stimulus supply device 24. Further, when applying an electron beam curable material, an electron beam irradiation device that irradiates an electron beam to the curable solution 12A (layer 12B to be cured that has been formed therewith) may be used as the second stimulus supply device 24.

UV irradiation conditions or electron beam irradiation conditions in the second stimulus supply device 24 are not particularly restricted so long as the conditions allow the layer 122B to be cured on the intermediate transfer drum 10 having the ink droplets 14A provided thereto by the ink jet recording head 14 to be transferred in a semi-cured state by the transfer device 16 to the recording medium P. The conditions may be selected in accordance with, for example, the position at which the stimulus is supplied to the layer 12B to be cured by the second stimulus supply device 24, the species of the curable material, and the thickness of the layer to be cured.

In this exemplary embodiment, the second stimulus supply device 24 is disposed at the downstream side of the ink jet recording head 14 but at the upstream side of the transfer device 16. However, as an alternative, the second stimulus supply device 24 may be disposed at the upstream side of the ink jet recording head 14. When the second stimulus supply device 24 is disposed at the upstream side of the ink jet recording head 14, the ink droplets 14A are discharged by the ink jet recording head 14 to the layer 12B to be cured after initiation of a cationic curing reaction of the curable material contained in the layer 12B to be cured. Accordingly, since the ink droplets 14A are received after the viscosity is increased by the progress of curing of the layer 12B to be cured, the diffusion of the ink droplets 14A, within the layer 12B to be cured is suppressed to form a high-quality image.

In this exemplary embodiment, both of the second stimulus supply device 24 and the stimulus supply device 18 are used; however, it is possible to use only the second stimulus supply device 24. In some cases depending on the conditions, the cationic curing reaction continues even after the supply of stimuli is stopped. In such cases, once stimuli are applied from the second stimulus supply device 24 to the layer 12B to be cured, the cationic curing reaction continues even after the layer 122B to be cured in a semi-cured state is transferred to the recording medium P by the transfer device 16, whereby the layer may reach a sufficiently cured state.

The term "semi-cured state" used herein refers to such a state that the curable material has not reached "sufficiently cured state" defined above but has been more cured than when supplied to the intermediate transfer member, so that the curable material is no longer in a completely liquid state. An exemplary method for confirming "semi-cured state" is as follows. Specifically, pervious paper (for example, plain paper) is placed on a layer 12B to be cured, and the layer 12B is assumed to be in the "semi-cured state" if the layer 12B to be cured is not transferred at all to the paper when no load is applied but is transferred partially when 200 g of load is applied.

In the recording apparatus 103 according to this exemplary embodiment described above, the layer 12B to be cured is semi-cured by the second stimulus supply device 24 after the ink droplets 14A are discharged by the ink jet recording head 14 and are provided to the layer 12B to be cured that is supplied on the intermediate transfer drum 10. Then, the layer 12B to be cured is transferred to the recording medium P by the transfer device 16. At the time of transfer, the layer 12B to be cured is transferred in a semi-cured state (i.e., in a state having a certain degree of rigidity) to the recording medium P.

Since the elements and constitutions shown by the other reference characters than those described above are the same as those in the first exemplary embodiment, descriptions thereof are omitted.

In the recording apparatus according to any one of the exemplary embodiments described above, the curable solution 12A is coated on the intermediate transfer member (intermediate transfer drum 10, intermediate transfer belt 22) to form the layer 12B to be cured. Then, after providing ink to the layer 12B to be cured to form an image T, the layer 12B to be cured is transferred to the recording medium P. Then, the layer 12B to be cured having the image T formed thereon is completely cured.

Although the recording apparatuses in the first exemplary embodiment to the third exemplary embodiment adopt a constitution (intermediate transfer method) that uses an intermediate transfer member (intermediate transfer drum 10 or intermediate transfer belt 22), a direct recording method may be used particularly when an impervious recording medium is used as the recording medium P. Specifically, a method may be mentioned which includes, for example, supplying the curable solution 12A directly to the recording medium P by the solution supply device 12 to form the layer 12B to be cured, discharging, from the inkjet recording head 14, the ink droplets 14A to the layer 12B to be cured to form image T, and curing the layer 12B to be cured by the simulation supply device 18.

Examples of the curable material include UV curable materials and electron beam curable materials. UV curable materials are easy to cure, have higher curing rate compared with other curable materials and easy to handle. Electron beam curable materials enable high speed printing since the curing reaction proceeds faster, and coloration after curing may be suppressed easily since the amount of polymerization initiator may be decreased.

The curable solution 12A containing the curable material may be slightly volatile or nonvolatile at a normal temperature (25° C.). The term "slightly volatile" means that the boiling point is 200° C. or higher under an atmospheric pressure. Further, the term "non-volatile" means that the boiling point is 300° C. or higher under an atmospheric pressure. The same applies hereinafter.

"Cationic UV curable resins" obtained by curing a cationic UV curable material include, for example, epoxy resin, oxetane resin, polyvinyl ether resin, polycarbonate, and polycaprolactone. The curable solution 12A therefor contains at least one selected from cationic UV curable monomers, cationic UV curable macromers, cationic UV curable oligomers, and cationic UV curable prepolymers. Further, the curable solution 12A contains optionally a cationic UV polymerization initiator for allowing the cationic UV curing reaction to proceed.

Examples of cationic UV curable monomers include epoxy monomers, oxetane monomers, vinyl ether monomers, cyclic carbonates, and caprolactone derivatives. Further, as cationic UV curable macromers, cationic UV curable oligomers, and cationic UV curable prepolymers, a product obtained by polymerizing any of the above cationic UV curable monomers to a predetermined polymerization degree may be mentioned.

Examples of the cationic UV polymerization initiator include aryl diazonium salts, diaryl iodonium salts, triaryl sulfonium salts, nitrobenzyl tosylate, sulfonyl acetophenone, nitrobenzyl arylsulfonate ester, allene-ion complex derivatives, naphthyl sulfonium salts and triazine derivatives.

Examples of "cationic electron beam curable resin" obtained by curing a cationic electron beam curable material include epoxy resin, oxetane resin, polyvinyl ether resin, polycarbonate, and polycaprolactone. The curable solution 12A therefor contains at least one selected from cationic electron beam curable monomers, cationic electron beam curable macromers, cationic electron beam cationic curable oligomers, and cationic electron beam curable prepolymers.

As cationic electron beam curable monomers, the cationic electron beam curable macromers, the cationic electron beam curable oligomers, and the cationic electron beam curable prepolymers, similar materials to cationic UV curable materials may be mentioned.

Among them, in view of suppressing curl and cockle, the curable resin is preferably, for example, epoxy resin or oxetane resin. Preferable curable materials include cyclohexene epoxide, 4-vinylcyclohexene-1,2-epoxide, phenylglycidyl ether, phenyl-2-methyl glycidyl ether, glycidyl vinyl ether, (3',4'-epoxycyclohexane) methyl-3,4-epoxycyclohexane carboxylate, 3-oxiranyl-7-oxabicyclo[4.1.0]heptane, 1-methyl-4-2-methyloxiranyl-7-oxabicyclo[4.1.0]heptane, hexamethylene dioxirane, octamethylene dioxirane, 1,3-bis (glycidyloxy)propane, 3-ethyl-3-hydroxymethyloxetane, 1,4-bis[(3-ethyl-3-oxetanylmethoxy)methyl]benzene, 3-methyl-3-(methoxymethyl)oxetane, and bis[3-ethyloxcetane-3-yl)methyl]terephthalate.

Further, the curable solution 12A may also contain a component that fixes the ink component on or inside the layer 12B to be cured (hereinafter referred to sometimes as "fixing component").

Although the fixing component is mixed with the curing solution 12A in advance in this exemplary embodiment, the fixing component may be incorporated to the layer 12B to be cured, for example by separately preparing a solution containing the fixing component, discharging the solution to the layer 12B to be cured by using a unit for discharging the solution. The step of discharging the solution containing the fixing component to the layer 12B to be cured may be conducted before discharging, by the ink jet recording head 14, the ink droplets 14A to the layer 12B to be cured.

Examples of the fixing component include, but not limited to, a component that absorbs a component (for example, solvent) of the ink, a component that adsorbs a component (for example, colorant) of the ink, and a component that aggregates, or increases the viscosity of, a component (for example, colorant) of the ink.

The component that absorbs a component (for example, solvent) of the ink may be, for example, a water absorbing material or an oil absorbing material.

When the ink is an aqueous ink, a water absorbing material may be used. When the layer 12B to be cured contains the water absorbing material, diffusion of the ink droplets 14A within the layer 12B to be cured may be suppressed since water contained in the aqueous ink is absorbed by the water absorbing material. Accordingly, the aqueous ink is fixed in the layer 12B to be cured, and forms a high-quality image. Further, inhibition of the cationic curing reaction by water is suppressed through the absorption of the water contained in the aqueous ink by the water absorbing material, the efficiency of the cationic curing reaction is maintained to form a high-quality image.

When the ink is an oil-based ink, an oil absorbing material may be used. When the layer 12B to be cured contains the oil absorbing material, diffusion of the ink droplets 14A within the layer 12B to be cured may be suppressed since the solvent contained in the oil-based ink is absorbed by the oil absorbing material. Accordingly, the oil-based ink is fixed within the layer 12B to be cured, and forms a high-quality image.

Specific water absorbing materials include, for example, polyacrylic acid and salts thereof, polymethacrylic acid and salts thereof, a copolymer including (meth)acrylic ester-(meth)acrylic acid and a salt thereof, a copolymer including styrene-(meth)acrylic acid and a salt thereof, a copolymer including styrene-(meth)acrylic ester-(meth)acrylic acid and a salt thereof, a copolymer including an ester formed from (meth)acrylic acid and an alcohol having an aliphatic or aromatic substituent wherein the aliphatic or aromatic substituent has styrene-(meth)acrylic ester-carboxylic acid and a salt structure thereof, a copolymer including an ester formed from (meth)acrylic acid and an alcohol having an aliphatic or aromatic substituent wherein the aliphatic or aromatic substituent has (meth)acrylate ester-carboxylic acid and a salt structure thereof, an ethylene-(meth)acrylic acid copolymer, a copolymer including butadiene-(meth)acrylic ester-(meth) acrylic acid and a salt thereof, a copolymer including an ester formed from (meth)acrylic acid and an alcohol having aliphatic or aromatic substituent wherein the aliphatic or aromatic substituent has butadiene-(meth)acrylic ester-carboxylic acid and a salt structure thereof, a copolymer including polymaleic acid and salts thereof, styrene-maleic acid and salts thereof, a product obtained by modifying any of the above resins with sulfonic acid, and products obtained by modifying any of the above resins with phosphoric acid. Preferable examples include polyacrylic acid and salts thereof, a copolymer including styrene-(meth)acrylic acid and a salt thereof, a copolymer including styrene-(meth) acrylic ester-(meth)acrylic acid and a salt thereof, a copolymer including an ester of (meth)acrylic acid and an alcohol having aliphatic or aromatic substituent wherein the aliphatic or aromatic substituent has styrene-(meth)acrylic ester-carboxylic acid and a salt structure thereof, and a copolymer including (meth)acrylic ester-(meth)acrylic acid and a salt thereof. The resins may be crosslinked, or may be not crosslinked.

Further, specific examples of the oil absorbing material include low molecular weight gelling agent such as hydroxystearic acid, cholesterol derivatives, and benzylidene sorbitol, polynorbornene, polystyrene, polypropylene, a styrene-butadiene copolymer and various rosins. Preferable examples include polynorbornene, polypropylene, and rosins.

The ratio of the component may be in the range of from about 0 to about 80 weight % based on the entire curable solution 12A.

Examples of the component that adsorbs a component (for example, colorant) of the ink include silica, alumina and zeolite. The ratio of the component may be within the range of from about 0 to about 30 weight %.

Examples of the component that aggregates, or increases the viscosity of, a component (for example, colorant) of the ink include coagulants such as inorganic electrolytes, organic acids and salts thereof, inorganic acids, and organic amines.

Examples of the inorganic electrolytes include salts of alkali metal ions such as lithium ion, sodium ion, and potassium ion, polyvalent metal ions, such as aluminum ion, barium ion, calcium ion, copper ion, iron ion, magnesium ion, manganese ion, nickel ion, tin ion, titanium ion, and zinc ion, hydrochloric acid, hydrobromic acid, hydroiodic acid, sulfuric acid, nitric acid, phosphoric acid, and thiocyanic acid.

Specific examples include alkali metal salts such as lithium chloride, sodium chloride, potassium chloride, sodium bromide, potassium bromide, sodium iodide, potassium iodide, sodium sulfate, potassium nitrate, and polyvalent metal salts such as aluminum chloride, aluminum bromide, aluminum sulfate, aluminum nitrate, sodium aluminum sulfate, potassium aluminum, sulfate, barium chloride, barium bromide, barium iodide, barium oxide, barium nitrate, barium thiocyanate, calcium chloride, calcium bromide, calcium iodide, calcium nitrite, calcium nitrate, dihydrogen calcium phosphate, calcium thiocyanate, calcium benzoate, copper chloride, copper bromide, copper sulfate, copper nitrate, iron chloride, iron bromide, iron iodide, iron sulfate, iron nitrate, magnesium chloride, magnesium bromide, magnesium iodide, magnesium sulfate, magnesium nitrate, manganese chloride, manganese sulfate, manganese nitrate, dihydrogen manganese phosphate, nickel chloride, nickel bromide, nickel sulfate, nickel nitrate, tin sulfate, titanium chloride, zinc chloride, zinc bromide, zinc sulfate, zinc nitrate, and zinc thiocyanate.

Specific examples of organic acids and salts thereof include alginic acid, citric acid, glycine, glutamic acid, succinic acid, tartaric acid, cysteine, oxalic acid, fumaric acid, phthalic acid, maleic acid, malonic acid, lysine, malic acid, acetic acid, oxalic acid, lactic acid, fumaric acid, salicylic acid, and benzoic acid, and sodium acetate, potassium oxalate, sodium citrate, potassium benzoate, aluminum acetate, calcium benzoate, calcium acetate, calcium salicylate, calcium tartrate, calcium lactate, calcium, fumarate, calcium citrate, copper acetate, iron oxalate, iron lactate, iron fumarate, iron citrate, magnesium acetate, magnesium lactate, manganese acetate, manganese salicylate, manganese benzoate, manganese lactate, nickel acetate, zinc acetate, a compound represented by the formula (1), and derivatives of the above compounds.

Formula (1)

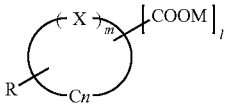

In Formula (1), X represents O, CO, NH, $NR_1$, S, or $SO_2$. $R_1$ represents an alkyl group, and, $R_1$ is preferably $CH_3$, $C_2H_5$, or $C_2H_4OH$. X is preferably CO, NH, $NR_1$, or O and, more preferably, CO, NH, or O.

R represents an alkyl group and R is preferably $CH_3$, $C_2H_5$, or $C_2H_4OH$. R may be contained or not contained in the formula.

M represents a hydrogen atom, an alkali metal or an amine. M is preferably H, Li, Na, K, monoethanol amine, diethanol amine, triethanol amine, or the like, and is more preferably, H, Na, K and, is further preferably, a hydrogen atom; n is an integer of 3 to 7, n is preferably such an integer that the heterocyclic ring in the formula is a 6-membered or 5-membered heterocyclic ring, or more preferably, 5-membered heterocyclic ring; m is 1 or 2. The compound represented by the formula (1) may be a saturated ring or unsaturated ring if the ring is a heterocyclic ring, and l is an integer of 1 to 5.

Specifically, the compound represented by the formula (1) is, for example, a compound having a furan, pyrrol, pyrroline, pyrrolidone, pyrone, pyrrol, thiophene, indole, pyridine, or quinoline structure and further having a carboxyl group as a functional group. Specific examples thereof include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolide-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrol-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxy proline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferable organic acids include citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, derivatives of these compounds, and salts thereof. More preferable examples include pyrrolidine carboxylic acid, pyrone carboxylic acid, pyrrole carboxylic acid, furan carboxylic acid, pyridine carboxylic acid, coumaric acid, thiophene carboxylic acid, nicotinic acid, derivatives of these compounds, and salts thereof. Further preferable examples include pyrrolidone carboxylic acid, pyrone carboxylic acid, furan carboxylic acid, coumaric acid, derivatives of these compounds, and salts thereof.

The organic amine compound may be any of a primary amine, a secondary amine, a tertiary amine, a quaternary amine, or a salt of a primary, secondary, tertiary or quaternary amine. Specific examples thereof include tetraalkyl ammoniums, alkylamines, benzalkoniums, alkylpyridiums, imidazoliums, polyamines, derivatives thereof, and salts thereof. Specifically, for example, the following may be mentioned: amylamine, butylamine, propanol amine, propyl amine, ethanol amine, ethylethanol amine, 2-ethylhexyl amine, ethylmethyl amine, ethyl benzyl amine, ethylene diamine, octyl amine, oleyl amine, cyclooctyl amine, cyclobutyl amine, cyclopropyl amine, cyclohexyl amine diisopropanol amine, diethanol amine, diethyl amine, di(2-ethylhexyl) amine, diethylene triamine, diphenyl amine, dibutyl amine, dipropyl amine, dihexyl amine, dipentyl amine, 3-(dimethylamino) propyl amine, dimethylethyl amine, dimethylethylene diamine, dimethyloctyl amine, 1,3-dimethylbutyl amine, dimethyl-1,3-propane diamine, dimethylhexyl amine, amino-butanol, amino-propanol, amino-propanediol, N-acetylamino ethanol, 2-(2-aminoethylamino)-ethanol, 2-amino-2-ethyl-1,3-propanediol, 2-(2-aminoethoxy)ethanol, 2-(3,4-dimethoxyphenyl)ethylamine, cetylamine, triisopropanol amine, triisopentyl amine, triethanol amine, trioctylamine, tritylamine, bis(2-aminoethyl)1,3-propane di-amine, bis(3-aminopropyl)ethylene diamine, bis(3-aminopropyl)1,3-propane diamine, bis(3-aminopropyl)methylamine, bis(2-ethylhexyl)amine, bis(trimethylsilyl)amine, butylamine, butylisopropylamine, propanediamine, propyldiamine, hexylamine, pentylamine, 2-methyl-cyclohexylamine, methylpropylamine, methylbenzylamine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxyethyl stearyl amine, 2-heptadecenyl-hydroxyethyl imidazoline, lauryl dimethyl benzyl ammonium chloride, cetyl pyridinium chloride, stearamide methyl pyridium chloride, diallyl dimethyl ammonium chloride polymers, diallylamine polymers, and monoarylamine polymers.

More preferable ones include triethanol amine, triisopropanol amine, 2-amino-2-ethyl-1,3-propane diol, ethanol amine, propane diamine, and propyl amine.

Among these coagulants, it is preferable to use polyvalent metal salts such as $Ca(NO_3)$, $Mg(NO_3)$, $Al(OH)_3$, and polyaluminum chloride.

Only a single coagulant may be used, or a mixture of two or more coagulants may be used. The content of coagulant may be within a range of from 0.01 weight % to 30 weight %.

Further, the curable solution may also contain an organic solvent for dissolving or dispersing main components contributing to the curing reaction (for example, a monomer, a macromer, an oligomer, a prepolymer, a polymerization initiator, etc.). The ratio of the main components is, for example, 30 weight % or more, preferably 60 weight % or more, and further preferably 90 weight % or more.

Further, the curable solution may contain various colorants for the purpose of controlling the color of the layer after curing.

Further, the viscosity of the curable solution is, preferably, from 5 mPa·s to 10,000 mPa·s and, more preferably, from 10 mPa·s to 5000 mPa·s and, further preferably, from 15 mPa·s to 3000 mPa·s. Further, the viscosity of the curable solution may be higher than the viscosity of the ink.

It is advantageous in terms of obtained effects to use the curable solution in the recording apparatus shown in any of the first to third exemplary embodiments described above. However, particularly when recording is conducted on an impervious recording medium, an image may be formed by coating a curable solution directly on the recording medium, discharging an ink containing a recording agent onto a layer to be cured that has been formed on the recording medium, supplying a stimulus for curing the layer to be cured, and curing the layer to be cured.

The ink used in the above exemplary embodiments will be described.

As the ink, any of an aqueous ink containing an aqueous solvent as the solvent and an oil-based ink containing an oil solvent as the solvent may be used. In these exemplary embodiments, good image fixability may be obtained without evaporating the solvent by a heater or the like when an aqueous or oil-based ink and an impervious medium as a recording medium are used.

Further, a UV curable ink is also usable as the ink. By using the UV curable ink, a highly durable image is formed.

The aqueous ink may be, for example, an ink prepared by dispersing or dissolving a water-soluble dye or pigment as a recording substance in an aqueous solvent. Further, the oil-based ink may be, for example, an ink prepared by dissolving an oil-soluble dye as a recording substance in an oil solvent or an ink prepared by dispersing a dye or pigment as a recording substance by reverse micellation.

When using the oil-based ink, an oil-based ink using a slightly volatile or non-volatile solvent, may be used. Since the solvent for the oil-based ink is slightly volatile or non-volatile, the state of the ink is less likely to be changed by evaporation of the solvent at the end of a head nozzle, head nozzle shows satisfactory clogging resistance. Further, since the solvent for the oil-based ink is slightly volatile or non-volatile, curl and cockle are less likely to occur even when the solvent for the oil-based ink penetrates into the recording medium after the layer to be cured that has received the ink droplets is transferred to the recording medium. Further, the solvent for the oil-based ink may be cationically curable.

First, the recording substance is to be described. A typical recording substance is a colorant. As the colorant, dyes and pigments are both usable; pigments are preferred in view of durability. As the pigment, organic pigments and inorganic pigments are both usable. Exemplary black pigments include carbon black pigments such as furnace black, lamp black, acetylene black, and channel black. Other pigments than black pigments and pigments of three primary colors of cyan, magenta and yellow, are also usable, examples of which include pigments of specific colors such as red, green, blue, brown, and white, metal luster pigments such as pigments of gold color and pigments of silver color, colorless or light-colored body pigments, and plastic pigments. Further, pigments that are synthesized newly for the invention may also be used.

Further, it is also possible to use, as a pigment particles including silica, alumina, or polymer beads as the core and a dye or pigment fixed to the surface of the core, insoluble lake product of a dye, a colored emulsion, a colored latex, or the like.

Specific examples of the black pigment include, but are not limited to, Raven 7000, Raven 5750, Raven 5250, Raven 5000, ULTRA II, Raven 3500, Raven 2000, Raven 1500, Raven 1250, Raven 1200, Raven 1190, ULTRA II, Raven 1170, Raven 1255, Raven 1080, Raven 1060 (manufactured by Columbian Carbon Co.) Regal 400R, Regal 330R, Regal 660R, Mogul L, Black Pearls L, Monarch 700, Monarch 800, Monarch 880, Monarch 900, Monarch 1000, Monarch 1100, Monarch 1300, Monarch 1400 (manufactured by Cabot Co.) Color Black FW1, Color Black FW2, Color Black FW2V, Color Black 18, Color Black FW 200, Color Black S150, Color Black S160, Color Black S170, Printex 35, Printex U, Printex V, Printex 140U, Printex 140V, Special Black 6, Special Black 5, Special Black 4A, Special Black 4 (manufactured by Degussa Co.), No. 25, No. 33, No. 40, No. 47, No. 52, No. 900, No. 2300, MCF-88, MA 600, MA7, MA8, MA10 (manufactured by Mitsubishi Chemical Corporation).

Specific examples of the cyan pigments include, but are not limited to, C.I. Pigment Blue-1, -2, -3, -15, -15:1, -15:2, -15:3, -15:4, -16, -22, and -60.

Specific examples of magenta pigments include, but are not limited to, C.I. Pigment Red-5, -7, -12, -48, -48:1, -57, -112, -122, -123, -146, -168, -177, -184, -202, and C.I. Pigment Violet-19.

Specific examples of yellow pigments include, but are not limited to, C.I. Pigment Yellow-1, -2, -3, -12, -13, -14, -16, -17, -73, -74, -75, -83, -93, -95, -97, -98, -114, -128, -129, -138, -151, -154, and -180.

When using a pigment as the colorant, a pigment dispersant may be used together. Usable pigment dispersants include polymer dispersants, anionic surfactants, cationic surfactants, amphoteric surfactants, and nonionic surfactants.

As the polymer dispersant, a polymer having a hydrophilic structure part and a hydrophobic structure part may be used. The polymer having a hydrophilic structure part and a hydrophobic structure part may be a condensation type polymer or an addition polymer. The condensation type polymer may be a known polyester-based dispersant. The addition polymer may be an addition polymer of a monomer having an α,β-ethylenic unsaturated group. A desired polymer dispersant is obtained by copolymerizing a monomer having an α,β-ethylenic unsaturated group having a hydrophilic group and a monomer having an α,β-ethylenic unsaturated group having a hydrophobic group in combination. Further, a homopolymer of a monomer having an α,β-ethylenic unsaturated group having a hydrophilic group is also usable.

The monomer having an α,β-ethylenic unsaturated group having the hydrophilic group may be a monomer having a carboxylic group, a sulfonic group, a hydroxyl group, a phospholic group, etc., examples of which include, acrylic acid, methacrylic acid, crotonic acid, itaconic group, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxyethyl phosphate, bismethacryloxyethyl phosphate, methacryloxyethyl phenyl acid phosphate, ethylene glycol dimethacrylate, and diethylene glycol dimethacrylate.

Examples of the monomer having an α,β-ethylenic unsaturated group having a hydrophobic group include styrene derivatives such as styrene, α-methylstyrene, and vinyltoluene, vinylcyclohexane, vinylnaphthalene, vinylnaphthalene derivatives, alkyl acrylate esters, alkyl methacrylate esters, phenyl methacrylate esters, cycloalkyl methacrylate esters, alkyl crotonate esters, dialkyl itaconate esters, and dialkyl maleate esters.

Examples of copolymers used as the polymer dispersant include styrene-styrene sulfonic acid copolymers, styrene-maleic acid copolymers, styrene-methacrylic acid copolymers, styrene-acrylic acid copolymers, vinyl naphthalene-maleic acid copolymers, vinylnaphthalene-methacrylic acid copolymers, vinyl naphthalene-acrylic acid copolymers, alkyl acrylate ester-acrylic acid copolymers, alkyl methacrylate ester-methacrylic acid copolymers, styrene-alkyl methacrylate ester-methacrylic acid copolymers, styrene-alkyl acrylate ester-acrylic acid copolymers, styrene-phenyl methacrylate ester-methacrylic acid copolymers, and styrene-cyclohexyl, methacrylate ester-metharcrylic acid copolymers. Further, monomers having a polyoxyethylene group or a hydroxyl group may be copolymerized with the polymers described above.

The polymer dispersant may have a weight average molecular weight of, for example, from 2,000 to 50,000.

Only a single pigment dispersant may be used, or two or more pigment dispersants may be used in combination. Since the amount of pigment dispersant to be added varies greatly pigment by pigment, it cannot be defined uniquely, but the total amount of pigment dispersant to be added is usually from 0.1 to 100 weight % based on the amount of pigment.

A pigment that is self-dispersible in water may be used as the colorant. The pigment that is self-dispersible in water refers to a pigment which has many water-solubilizing groups on the surface of the pigment and can disperse in water even in the absence of a polymer dispersant. Specifically, a pigment that is self-dispersible in water may be obtained by subjecting usual pigments to a surface modifying treatment such as an acid/base treatment, a coupling agent treatment, a polymer grafting treatment, a plasma treatment or a redox treatment.

The pigment that is self-dispersible in water may be the pigment prepared by subjecting a pigment to a surface modifying treatment. However, it is also possible to use commercially available self-dispersible pigments such as CAB-O-JET-200, CAB-O-JET-300, IJX-157, IJX-253, IJX-266, IJX-273, IJX-444, IJX-55, CAB-O-JET-260M, CAB-O-JET-250C, CAB-O-JET-270Y, CAB-O-JET-1027R, CAB-O-JET-554B, manufactured by Cabot Co. and Microjet Black CW-1 and CW-2 manufactured by Orient Chemical Co.

The self-dispersible pigment is preferably a pigment having, on the surface thereof, at least sulfonic acid, a sulfonic acid salt, carboxylic acid, or a carboxylic acid salt as a functional group, and is more preferably a pigment having, on the surface thereof, at least carboxylic acid or a carboxylic acid salt as a functional group.

Further, a pigment coated with a resin is also usable. This pigment is referred to as a microcapsule pigment. Usable microcapsule pigments include not only commercial microcapsule pigments such as those manufactured by Dai-Nippon Ink Chemical Industry Co. and Toyo Ink Co. but also microcapsule pigments manufactured for the invention.

Further, a resin dispersion type pigment in which a polymeric substance is adsorbed physically or bonded chemically to a pigment (, which may be selected from the above pigments) is also usable.

Other examples of the recording substance include dyes such as hydrophilic anion dyes, direct dyes, cation dyes, reactive dyes, polymer dyes, and oil-soluble dyes, a wax powder, resin powder, or emulsion colored with a dye, fluorescence dyes and fluorescence pigments, IR absorbents, UV absorbents, magnetic materials such as ferromagnetic materials such as ferrite or magnetite, semiconductors or photocatalysts such as titanium oxide and zinc oxide, as well as other organic and inorganic electronic material particles.

The content (concentration) of the recording substance is, for example, within a range from 5 to 30 weight % based on the weight of ink.

The volume average particle size of the recording substance is, for example, within a range from 10 nm 1,000 nm.

The volume average particle size of the recording substance means the particle size of the recording substance per se, or, if additives such as dispersant are adhered to the recording substance, the particle size of the particle including the adhered additives. A MicroTrack UPA particle size analyzer 9340 (manufactured by Leed & Narthrup Co.) is used as the apparatus for measuring the volume average particle size. The measurement is conducted on 4 ml of ink in a measuring cell according to a predetermined measuring method. With respect to the input values upon measurement, the viscosity of the ink is assumed to be the viscosity and the density of the recording substance is assumed to be the density of the dispersed particles.

Next, the aqueous solvent is to be described. The aqueous solvent may be water and, in particular, ion exchanged water, ultrapure water, distilled water, or ultrafiltration water is used preferably. Further, a water-soluble organic solvent may also be used together with the aqueous solvent. Usable water-soluble organic solvents include polyhydric alcohols, polyhydric alcohol derivatives, nitrogen-containing solvents, alcohols, and sulfur-containing solvents.

Specific examples of water-soluble organic solvents include polyhydric alcohols such as ethylene glycol, diethylene glycol, propylene glycol, butylene glycol, triethylene glycol, 1,5-pentane diol, 1,2-hexane diol, 1,2,6-hexane triol, glycerin, and trimethylol propane, sugar alcohols such as xylitol, and saccharides such as xylose, glucose, and galactose.

Exemplary polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerin.

Exemplary nitrogen-containing solvents include pyrrolidone, N-methyl-2-pyrrolidone, cyclohexyl pyrrolidone, and triethanol amine. Exemplary alcohols include alcohols such as ethanol, isopropyl alcohol, butyl alcohol, and benzyl alcohol.

Exemplary sulfur-containing solvents include thiodiethanol, thiodiglycerol, sulfolan, and dimethylsulfoxide.

Other examples of water-soluble organic solvents include propylene carbonate and ethylene carbonate.

At least one water-soluble organic solvent may be used. The content of water-soluble organic solvent is, for example, within a range from 1 weight % to 70 weight %.

In the following, the oil solvent is described. The oil solvent may be an organic solvent such as an aliphatic hydrocarbon, an aromatic hydrocarbon, an alcohol, a ketone, an ester, an ether, a glycol, a nitrogen-containing solvent, or a plant oil. Examples of the aliphatic hydrocarbon include n-hexane, cyclohexane, methylhexane, n-octane, methylheptane, dimethylhexane, nonane, and decane, and paraffin solvents such as n-paraffin solvent (e.g., Isopar), iso-paraffin solvents, and cyclo paraffin solvents. The aromatic hydrocarbon may be toluene, ethyl benzene, or xylene. The alcohol may be methanol, ethanol, propanol, butanol, hexanol, or benzylalcohol. The ketone may be acetone, methyl ethyl ketone, pentanone, hexanone, heptanone, or cyclohexanone. The ester may be methyl acetate, ethyl acetate, vinyl acetate, ethyl propionate, or ethyl butyrate. The ether may be diethyl ether, ethyl propyl ether, ethyl propyl ether, or ethyl isopropyl ether. The glycol may be ethylene glycol, diethylene glycol, propane diol, hexane diol, glycerin, or polypropylene glycol. It is also possible to use a glycol derivative such as ethylene glycol methyl ether, ethylene glycol ethyl ether, ethylene glycol butyl ether, diethylene glycol ethyl ether, or diethylene glycol butyl ether as the solvent. The plant oil may be a drying oil, a semi-drying oil, or a non-drying oil. Exemplary drying oils include perilla oil, linseed oil, tung oil, poppy seed oil, walnut oil, safflower oil, and sunflower oil. Exemplary semi-drying oils include rapeseed oil, and exemplary non-drying oils include palm oil. Only one oil solvent may be use, or two or more oil solvents may be used in combination.

Other additives are described below. A surfactant may be added to the ink, as necessary.

Usable surfactants include various anionic surfactants, nonionic surfactants, cationic surfactants, and amphoteric surfactants. Anionic surfactants and nonionic surfactants are preferable.

Specific examples of the surfactants are described below.

Examples of usable anionic surfactants include alkylbenzene sulfonate salts, alkylphenyl sulfonate salts, alkylnaphthalene sulfonate salts, higher fatty acid salts, sulfate ester salts of higher fatty acid esters, sulfonate acid salts of higher fatty acid esters, sulfate ester salts and sulfonate salts of higher alcohol ethers, higher alkyl sulfosuccinate salts, polyoxyethylene alkyl ether carboxylate salts, polyoxyethylene alkyl ether sulfate salts, alkyl phosphate salts, and polyoxyethylene alkyl ether phosphate salts. Preferable examples include dodecyl benzene sulfonate salts, propropyl naphthalene sulfonate salts, monobutyl phenyl phenol monosulfonate salts, monobutyl biphenyl sulfonate salts, monobutyl biphenyl sulfonate salts, and dibutyl phenyl phenol disulfonate salts.

Examples of usable nonionic surfactants include polyoxyethylene alkyl ether, polyoxyethylene alkyl phenyl ether, polyoxyethylene fatty acid ester, sorbitan fatty acid ester, polyoxyethylene sorbitan fatty acid ester, polyoxyethylene sorbitol fatty acid ester, glycerin fatty acid ester, polyoxyethylene glycerin fatty acid ester, polyglycerin fatty acid ester, sucrose fatty acid ester, polyoxyethylene alkylamine, polyoxyethylene fatty acid amide, alkylalkanol amide, polyethylene glycol polypropylene glycol block copolymer, acetylene glycol, and polyoxyethylene adducts of acetylene glycol. Preferable examples include polyoxyethylene nonylphenyl ether, polyoxyethylene octylphenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethylene glycol polypropylene glycol block copolymer, acetylene glycol, and polyoxyethylene adducts of acetylene glycol.

Other usable surfactants include silicone-containing surfactants such as polysiloxane oxyethylene adducts, fluorine-containing surfactant such as perfluoroalkyl carboxylate salts, perfluoroalkyl sulfonate salts, and oxyethylene perfluoroalkyl ethers, and bio surfactants such as spiculisporic acid, rhamnolipid, and lysolecithin.

Only a single surfactant may be used, or a mixture of plural surfactants may be used. Further, the hydrophilic/hydrophobic balance (HLB) of the surfactant may be, for example, within the range from 3 to 20 in view of the solubility or the like.

The addition amount of the surfactant is, for example, from 0.001 to 5 weight % and, preferably, from 0.01 to 3 weight %.

To the ink, the following agents may be added: for controlling the penetrating property, penetrants; for controlling the properties such as for improving the ink jetting property, polyethylene imine, polyamines, polyvinyl pyrrolidone, polyethylene glycol, ethyl cellulose, carboxymethyl cellulose, etc.; for adjusting the conductivity and pH, alkali metal compounds such as potassium, hydroxide, sodium hydroxide, lithium hydroxide; and, as necessary, pH buffers, antioxidants, antimolds, viscosity controllers, conductive agents, UV-absorbers, chelating agents, etc.

Next, exemplary properties of the ink are described. The surface tension of the ink is, for example, in the range from 20 to 45 mN/m.

The surface tension mentioned above is a value obtained by a measurement with a Wilhelmy type surface tension meter (manufactured by Kyowa Interface Science Co., Ltd.) in an environment of 23° C., 55% RH.

The viscosity of the ink may be from 1.5 mPa·s to 30 mPa·s and, preferably, from 1.5 mPa·s to 20 mPa·s. From the view point of the head discharging property, the ink viscosity is desirably 20 mPa·s or less. Further, the viscosity of the ink may be lower than the viscosity of the curable solution.

The viscosity mentioned above is a value obtained by a measurement with a RHEOMAT 115 (manufactured by Contraves Co.) as the measuring apparatus under a condition of a measuring temperature of 23° C. and a shear rate of 1400 $s^{-1}$.

The ink is not restricted to the constitution described above. Other than the recording substance, the ink may contain functional materials, such as liquid crystal materials and electronic materials.

Although ink droplets 14A are selectively jetted from the ink jet recording head 14 for each of black, yellow, magenta and cyan colors based on the image data and a full color image is recorded on the recording medium P in the exemplary embodiments described above, the present invention is not limited to the recording of characters or images on the recording medium. That is, the apparatus according to the invention is applicable to industrially utilized liquid droplet discharging (jetting) apparatuses in general.

EXAMPLES

In the following, the present invention is described more specifically with reference to examples. However, these examples should not be construed as limiting the the invention.

Example 1

By using a recording apparatus having a similar constitution to the first exemplary embodiment (refer to FIG. 1 and FIG. 2), a curable solution is supplied by a liquid supply device to an intermediate transfer drum to form a layer to be cured, and the respective inks are jetted from the recording heads to the layer to be cured, so as to form an image. Then, after transferring the layer to be cured to a recording medium by the transfer device, stimuli are supplied from the stimulus supply device to cure the layer to be cured, to complete printing. Evaluations are conducted under the following conditions.

Intermediate transfer drum: steel pipe with an outer diameter of 500 mm coated with a fluorine-containing resin (drum (processing speed): 400 mm/s)

Liquid supply device: gravure roll coater (thickness of layer to be cured: 10 μm)

Each recording head: piezo type recording head (resolution 600 dpi (dpi: number of dots per 1 inch; the same applies hereinafter)

Transfer device (pressure roll): steel pipe of 30 mm diameter coated with a fluorine-containing resin. (urging force against intermediate transfer drum: linear pressure of 3 kgf/cm)

Stimulus supply device: high pressure mercury lamp (UV irradiation intensity: 80 W/cm)

Recording medium: two types—art paper (OK Kinfuji) and plain paper (FX-P paper (manufactured by Fuji Xerox).

The curable solution and the inks of the respective colors manufactured as described below are used.

| Curable solution 1 (cationic curable liquid thin film material) | |
|---|---|
| (3',4'-epoxy cyclohexane)methyl-3,4-epoxycyclohexane carboxylate: | 60 weight parts |
| 1-methyl-4-2-methyloxyranyl 7-oxabicyclo [4.1.0] heptane: | 30 weight parts |

2 weight parts of triaryl sulfonium hexafluorophosphate (photopolymerization initiator) is added to the composition and 4-vinyl cyclohexene-1,2-epoxide is further added to set the viscosity to 120 mPa·s, whereby "curable solution 1" is obtained.

—Black Ink 1—

| | |
|---|---|
| Bk pigment dispersion liquid (prepared by adding SOLSPERSE 13940 (dispersant manufactured by Noveon Co.) to carbon black and dispersing them in ISOPAR L) (pigment concentration: 15 weight %): | 40 weight parts |
| ISOPAR L (manufactured by Exxon Mobil Corp.): | 20 weight parts |
| Ethyl oleate: | 26 weight parts |

ISOPAR G (manufactured by Exxon Mobil Corp.) and 5 weight parts of oleyl alcohol are added to the above composition, and the viscosity is controlled to form "Black ink 1". The viscosity is 6.5 mPa·s.

—Cyan Ink 1—

| | |
|---|---|
| Cyan pigment dispersion liquid (prepared by adding SOLSPERSE 16000 (dispersant manufactured by Noveon Co.) to phthalocyanine pigment and dispersing them in ISOPAR M) (pigment concentration: 10 weight %): | 50 weight parts |
| ISOPAR M (manufactured by Exxon Mobil Corp.): | 20 weight parts |
| Soybean oil: | 20 weight parts |

ISOPAR G and 8 weight parts of oleyl alcohol se added to the composition described above and the viscosity is controlled to form "Cyan ink 1". The viscosity is 7.5 mPa·s.

—Magenta Ink 1—

| | |
|---|---|
| Magenta pigment dispersion liquid (prepard by adding SOLSPERSE 34750 (dispersant manufactured by Noveon Co.) to quinacridone pigment and dispersed them is ISOPAR M) (pigment concentration: 15 weight %): | 30 weight parts |
| ISOSOL (manufactured by Nippon Oil Corp.): | 12 weight parts |
| Ethyl soybean oil: | 15 weight parts |
| Oleyl alcohol: | 30 weight parts |

ISOPAR G and 10 weight parts of oleyl alcohol are added to the above composition and the viscosity is controlled to form. "Magenta ink 1". The viscosity is 8.8 mPa·s.

—Yellow Ink 1—

| | |
|---|---|
| Yellow pigment dispersion liquid (prepared by adding DISPERBYK-101 (dispersant manufactured by BYK Japan KK) to Pigment Yellow 74 and dispersing them in ISOPAR G) (pigment concentration: 18 weight %): | 25 weight parts |
| ISOPAR M (manufactured by Exxon Mobil Corp.): | 40 weight parts |
| Butyl oleate: | 15 weight parts |

ISOPAR G and 5 weight parts of oleyl alcohol are added to the above composition and the viscosity is controlled to form "Yellow ink 1". The viscosity is 6.7 mPa·s.

"Curable solution 1" is coated by a gravure roll coater on the drum to form "liquid thin layer 1" of 8 μm thickness, then the four types of inks are provided respectively onto "liquid thin layer 1" with piezo heads (resolution 600 dpi). Then, the liquid thin layer 1 is transferred to art paper (OK Kinfuji) and plain paper (FX-P paper manufactured by Fuji Xerox Co.). Subsequently, UV irradiation is conducted on the transferred art paper and plain paper by a high pressure mercury lamp at 80 W/cm.

Comparative Example 1

Using the same respective inks as in Example 1, the inks are jetted from the respective recording heads directly onto the art paper (OK Kinfuji) and the plain paper (FX-P paper manufactured by Fuji Xerox Co.), to form an image. The transfer step and the UV-irradiation step are not conducted.

Comparative Example 2

Printing is conducted in the same manner as in Example 1 except that (i) the curable solution containing the curable material is not supplied to the intermediate transfer drum, (ii) the inks are jetted directly onto the intermediate transfer drum to form an image and then are transferred to the art paper (OK Kinfuji) and the plain paper (FX-P paper manufactured by Fuji Xerox Co.), and (iii) the UV irradiation step is not conducted.

Example 2

Curable Solution 2

Cationic Curable Liquid Thin Layer Material 50 weight parts of a crosslinked sodium polyacrylate salt is added as a water absorbing material to 50 weight pacts of the "curable solution 1" prepared in Example 1 to form "curable solution 2".

—Black Ink 2—

| | |
|---|---|
| Carbon black: | 5 weight parts |
| Styrene-acrylic acid-butyl acrylate ester copolymer: | 1.5 weight parts |
| Glycerin: | 25 weight parts |
| Diethylene glycol monobutyl ether: | 6 weight parts |
| Oxyethylene oleyl ether: | 0.5 weight part |

The above composition is mixed and, further, 60 weight parts of pure water and 0.1 weight part of sodium hydroxide are added thereto to obtain "Black ink 2".

—Cyan Ink 2—

| | |
|---|---|
| Copper phthalocyanine pigment: | 4 weight parts |
| Ethyl methacrylate-acrylic acid copolymer: | 2 weight parts |
| Diethylene glycol: | 15 weight parts |
| Glycerin: | 15 weight parts |
| Tetramethyldecinediol oxyethylene adduct: | 2 weight parts |
| 1,3-butanediol: | 4 weight parts |

The above composition is mixed and, further, 58 weight parts of pure water and 0.15 weight part of sodium hydroxide are added to obtain "Cyan ink 2".

—Magenta Ink 2—

| | |
|---|---|
| Magenta pigment (C.I. Pigment Red 122): | 6 weight parts |
| Styrene-methacrylic acid-ethylhexyl methacrylate ester copolymer: | 4 weight parts |
| Ethylene glycol: | 10 weight parts |
| Glycerin: | 15 weight parts |
| Propylene glycol: | 5 weight parts |
| Tetramethyldecinediol oxyethylene adduct: | 2.5 weight parts |

The above composition is mixed and, further, 65 weight parts of pure water and 0.1 weight part of sodium hydroxide are added to obtain "Magenta ink 2".

—Yellow Ink 2—

| | |
|---|---|
| Yellow pigment (C.I. Pigment Yellow 74): | 5 weight parts |
| Styrene-methacrylic acid-ethyl methacrylate ester copolymer: | 3 weight parts |
| Diethylene glycol: | 15 weight parts |
| Triethylene glycol monobutyl ether: | 8 weight parts |
| 1,2-hexanediol: | 5 weight parts |
| Oxyethylene lauryl ether: | 0.5 weight part |

The above composition is mixed and, further, 62 weight parts of pure water and 0.05 weight part of sodium hydroxide are added to obtain "yellow ink 2".

Printing is conducted in the same manner as in Example except for (i) using "curable solution 2" instead of "curable solution 1" and (ii) using "black ink 2", "cyan ink 2", "magenta ink 2", and "yellow ink 2" instead of "black ink 1", "cyan ink 1", "magenta ink 1", and "yellow ink 1", respectively.

Example 3

| Curable solution 3 (cationic curable liquid thin layer material) | |
|---|---|
| 3-Ethyl-3-hydroxymethyl oxetane: | 40 weight parts |
| 1,4-Bis[(3-ethyl-3-oxetanylmethoxy)methyl]benzene: | 30 weight parts |
| Polynorbornene (porous, oil absorbing material): | 30 weight parts |

IRGACURE 250 (photopolymerization initiator) is added to the above composition and the viscosity is adjusted to 90 mPa·s with 4-vinylcyclohexene-1,2-epoxide to form "curable solution 3".

Printing is conducted by the same process as in Example 1 except for using "curable solution 3" instead of "curable solution 1".

Reference Example 1

| Curable solution A (radical curable liquid thin film material) | |
|---|---|
| Ditrimethylolpropane tetraacrylate: | 50 weight parts |
| Glycerin propoxy triacrylate: | 30 weight parts |

1-hydroxy-cyclohexyl-phenyl-ketone (radical photopolymerization initiator) and PEG 300 diacrylate are added to the above composition to set the viscosity to 250 mPa·s.

Printing is conducted by the same process as in Example 1 except for using "curable solution A" instead of "curable solution 1".

Evaluation on Examples 1 to 3, Comparative Examples 1 and 2, and Reference Example 1 is conducted as described below.

—Evaluation on Drying Property—

Drying speed after printing is measured. Specifically, coated paper (high grade GCAA0002, manufactured by Fuji Xerox Co.) is placed on the printed image, and a load of 100 g/cm$^2$ is applied thereon. The time until the ink is no longer transferred to the stacked paper is measured. The evaluation criterion is as described below and grades G1 and G2 cause no practical problem. The results are shown in Table 1

G1: less than 1 sec after printing

G2: 1 sec or more but less than 2 sec after printing

G3: 2 sec or more but less than 5 sec after printing

G4: 5 sec or more after printing

—Evaluation on Bleed—

Character portions of obtained printed products are evaluated with naked eyes. The evaluation criterion is as described below and grades G1 and G2 cause no practical problem. The results are shown in Table 1.

G1: Bleed in characters is not recognized

G2: Bleed in characters is somewhat recognized but with no practical problem

G3: Bleed in characters is remarkable

—Evaluation on Fixability—

Image portions are rubbed with a finger 1 min after painting and stains on the finger is examined to determine the fixability. The evaluation criterion is as described below. Grades G1 and G2 cause no practical problem. The results are shown in Table 1.

G1: stain is not present
G2: slight stain is present
G3: stain is present

—Evaluation on Light Fastness—

From 24 hours after the completion of the printing, a Xenon lamp is irradiated for 12 hours and the degree of discoloration during the irradiation is functionally evaluated. The evaluation criterion is as described below and grades G1 and G2 cause no practical problem. The results are shown in Table 1.

G1: No discoloration at all
G2: Slight discoloration
G3: Remarkable discoloration —Evaluation on Gas Resistance—

Printed products on which 100% coverage pattern is printed are prepared, and the printed products are exposed to a condition of an ozone concentration of 1.0 ppm for 24 hours. The optical density of the printed products after exposure is measured by X-Rite 404. The evaluation criterion is as described below. Grades G1 and G2 cause no practical problem. The results are shown in Table 1.

G1: The ratio of optical density after exposure to the initial optical density is 90% or more.
G2: The ratio of optical density after exposure to the initial optical density is 80% or more but less than 90%.
G3: The ratio of optical density after exposure to the initial optical density is less than 80%.

—Evaluation on Curl Immediately after Printing—

On a sample prepared by leaving a recording paper in an environment of 23° C., 50% RH for 8 hours or more to control humidity and cutting the same into a postal card size (100×148 mm), a 100% magenta solid image is printed with a margin of 5 mm. The degree of the generated hanging curl at the opposite side to the printed surface generated immediately after discharged from the apparatus after printing is measured with a micrometer caliper. The obtained measured value is converted into a curl curvature to conduct evaluation. The evaluation criterion is as described below, and grades G1 and G2 cause no problem. The results are shown in Table 1.

G1: less than 20 $m^{-1}$
G2: 20 $m^{-1}$ or more but less than 35 $m^{-1}$
G3: 35 $m^{-1}$ or more but less than 50 $m^{-3}$
G4: 50 $m^{-1}$ or more.

—Evaluation on Cockle Immediately after Printing—

A 100% magenta solid image of 2 cm×2 cm is printed at a central portion of recording paper cut into a postal card size (100×148 mm) and the maximum height of waving generated immediately after printing is measured with a laser displacement sensor (LK 085 manufactured by KEYENCE Corp.). The evaluation standard is as described below and grades G1 and G2 cause no practical problem. The results are shown in Table 1

G1: less than 1.5 mm
G2: 1.5 mm or more but less than 2 mm
G3: 2 mm or more but less than 3 mm
G4: 3 mm or more —Evaluation on Curl after being Left to Dry—

A recording paper of a postal card size is left in an environment of 23° C., 50% RH for 8 hours or more so that its moisture content is controlled. A 100% magenta solid image is printed on the recording paper with a margin of 5 mm, and the recording paper is left flat with its printed surface facing upward in an environment of 23° C., 50% RH for 50 hours from printing. The amount of hanging curl generated after being left in the environment for 50 hours is measured in the same manner as the evaluation on curl immediately after printing. The obtained measurement value is converted to curl curvature and evaluated. The evaluation criterion is as described below and grades G1 and G2 cause no practical problems. The results are shown in Table 1.

G1: less than 20 $m^{-1}$
G2: 20 $m^{-1}$ or more but less than 35 $m^{-1}$
G3: 35 $m^{-1}$ or more but less than 50 $m^{-1}$
G4: 50 $m^{-1}$ or more —Evaluation on Cockle after being Left to Dry—

A 100% magenta solid image of 2 cm×2 cm is printed at a central portion of a recording paper cut into a postal card size (100×148 mm), and the recording paper is left flat with its printed surface facing upward in an environment of 23° C., 50% RH for 50 hours from printing. The maximum height of waving generated after being left in the environment for 50 hours is measured in the same manner as the evaluation on cockle immediately after printing. The evaluation criterion is as described below, and grades G1 and G2 cause no practical problem. The results are shown in Table 1.

G1: less than 1.5 mm
G2: 1.5 mm or more but less than 2 mm
G3: 2 mm or more but less than 3 mm
G4: 3 mm or more

TABLE 1

| | | | | | | | | | | | Curl | | Cockle | |
|---|---|---|---|---|---|---|---|---|---|---|---|---|---|---|
| Example No. | Curing resin | Ink | Liquid absorbing material | Recording method | Recording medium | Drying property | Bleed | Fixability | Light fastness | Gas resistance | Immediately after printing | After drying | Immediately after printing | After drying |
| Example 1 | Epoxy resin (cationic-curing type) | Oil-based | None | Intermediate transfer | Art paper | G1 | G2 | G1 | G1 | G1 | G1 | G1 | G1 | G1 |
| | | | | | Plain paper | G1 | G2 | G1 | G1 | G1 | G1 | G1 | G1 | G1 |
| Example 2 | Epoxy resin (cationic-curing type) | Aqueous | Water absorbing material | Intermediate transfer | Art paper | G1 | G1 | G1 | G1 | G1 | G1 | G1 | G1 | G1 |
| | | | | | Plain paper | G1 | G1 | G1 | G1 | G1 | G1 | G1 | G1 | G1 |
| Example 3 | Oxetan resin (cationic-curing type) | Oil-based | Oil absorbing material | Intermediate transfer | Art paper | G1 | G1 | G1 | G1 | G1 | G1 | G1 | G1 | G1 |
| | | | | | Plain paper | G1 | G1 | G1 | G1 | G1 | G1 | G1 | G1 | G1 |

TABLE 1-continued

| Example No. | Curing resin | Ink | Liquid absorbing material | Recording method | Recording medium | Drying property | Bleed | Fixability | Light fastness | Gas resistance | Curl: Immediately after printing | Curl: After drying | Cockle: Immediately after printing | Cockle: After drying |
|---|---|---|---|---|---|---|---|---|---|---|---|---|---|---|
| Comp. Example 1 | None | Oil-based | None | Direct recording | Art paper | G4 (*1) | G3 | G3 | G2 | G2 | G1 | G2 | G1 | G2 |
| | | | | | Plain paper | G2 | G3 | G2 | G1 | G3 | G1 | G2 | G1 | G2 |
| Comp. Example 2 | None | Oil-based | None | Intermediate transfer | Art paper | G4 (*1) | G3 | G3 | G2 | G2 | G1 | G2 | G1 | G2 |
| | | | | | Plain paper | G2 | G3 | G2 | G1 | G3 | G1 | G2 | G1 | G2 |
| Reference Example 1 | Acrylic resin (radical-curing type) | Oil-based | None | Intermediate transfer | Art paper | G1 | G1 | G1 | G1 | G1 | G1 | G2 | G1 | G2 |
| | | | | | Plain paper | G1 | G1 | G1 | G1 | G1 | G1 | G2 | G1 | G2 |

(*1): Solvent remains on the paper and image is not fixed.

Example 4

| Curable solution 4 (cationic curable liquid thin layer material) | |
|---|---|
| 3-oxiranyl-7-oxabicyclo[4.1.0]heptane: | 15 weight parts |
| Octamethylene dioxirane: | 25 weight parts |
| Bis[(3-ethyloxetane-3-yl)methyl]terephthalate: | 35 weight parts |
| Styrene-acrylic ester-sodium acrylate salt copolymer (water absorbing material): | 25 weight parts |

4-(phenylthio)phenyl diphenyl sulfonium hexafluorophosphate (photopolymerization initiator) is added to the above composition and the viscosity is adjusted to 90 mPa·s with 4-vinyl cyclohexene-1,2-epoxide to form "curable solution".

—Black Ink 4—

| | |
|---|---|
| CAB-O-JET-300 (self-dispersible pigment dispersion liquid): | 30 weight parts |
| Glycerin: | 15 weight parts |
| Diethylene glycol: | 15 weight parts |
| SURFYNOL 465: | 1.0 weight part |

The above composition is mixed and, further, 40 weight parts of pure water is added thereto to obtain "Black ink 4".

—Cyan Ink 4—

| | |
|---|---|
| CAB-O-JET-250C (self-dispersible pigment dispersion liquid): | 35 weight parts |
| Diethylene glycol: | 12 weight parts |
| Tetraethylene glycol: | 10 weight parts |
| 1,2-Hexanediol: | 4 weight parts |
| 1,3-Butanediol: | 4 weight parts |
| SURFYNOL 440: | 0.7 weight parts |
| SURFYNOL 485: | 0.8 weight parts |

The above composition is mixed and, further, 37 weight parts of pure water is added thereto to obtain "Cyan ink 4".

—Magenta Ink 4—

| | |
|---|---|
| CAB-O-JET-260M (self-dispersible pigment dispersion liquid): | 50 weight parts |
| Ethylene glycol: | 8 weight parts |
| Glycerin: | 15 weight parts |

-continued

| | |
|---|---|
| Propylene glycol: | 3 weight parts |
| Tetramethyldecynediol oxyethylene adduct: | 2.5 weight parts |

The above composition is mixed and, further, 25 weight parts of pure water is added thereto to obtain "Magenta ink 4".

—Yellow Ink 4—

| | |
|---|---|
| CAB-O-JET-270Y (self-dispersible pigment dispersion liquid): | 45 weight parts |
| Diethylene glycol: | 15 weight parts |
| Triethylene glycol monobutyl ether: | 8 weight parts |
| 1,3-Butanediol: | 4 weight parts |
| Oxyethylene stearyl ether: | 0.9 weight parts |

The above composition is mixed and, further, 28 weight parts of pure water is added thereto to obtain "Yellow ink 4".

Printing is conducted in the same manner as in Example 1 except for (i) using "curable solution 4" instead of "curable solution 1" and (ii) using "black ink 4" "cyan ink 4", "magenta ink 4", and "yellow ink 4" instead of "black ink 1", "cyan ink 1", "magenta ink 1", and "yellow ink 1", respectively.

Comparative Example 3

Using the same inks as in Example 4, the inks are jetted from the respective recording heads directly onto art paper (OK Kinfuji) and plain paper (FX-P paper manufactured by Fuji Xerox Co.) to form an image. However, the transfer step and the UV-irradiation step are not conducted.

Example 5

Instead of supplying "curable solution 4" to the intermediate transfer drum, the curable solution 4 is coated on art paper (OK Kinfuji) by a gravure roll coater to form "liquid thin layer 4" of 10 μm thickness. Then, the same inks as those used in Example 4 are respectively provided on "liquid thin layer 4" by piezo heads (resolution: 600 dpi) to form an image. Subsequently, UV irradiation is conducted on the art paper by a high pressure mercury lamp at 80 W/cm.

The evaluation on Example 4 to Example 5 and Comparative Example 3 described above is conducted in the same manner as in Examples 1 to 3, Comparative Examples 1 to 2, and Reference Example 1 described above.

The results are shown in Table 2.

TABLE 2

| Example No. | Curing resin | Ink | Liquid absorbing material | Recording method | Recording medium | Drying property | Bleed | Fix-ability | Light fast-ness | Gas resis-tance | Curl: Imme-diately after printing | Curl: After dry-ing | Cockle: Imme-diately after printing | Cockle: After dry-ing |
|---|---|---|---|---|---|---|---|---|---|---|---|---|---|---|
| Example 4 | Epoxy/ oxetane resin (cationic curing) | Aqueous | Water absorbing material | Intermediate transfer | Art paper | G1 | G1 | G1 | G1 | G1 | G1 | G1 | G1 | G1 |
| | | | | | Plain paper | G1 | G1 | G1 | G1 | G1 | G1 | G1 | G1 | G1 |
| Example 5 | Epoxy/ oxetane resin (cationic curing) | Aqueous | Water absorbing material | Direct recording | Art paper | G1 | G1 | G1 | G2 | G2 | G1 | G1 | G1 | G1 |
| Comp. Example 3 | None | Aqueous | None | Direct recording | Art paper | G4 | G3 | G3 | G3 | G3 | G1 | G2 | G1 | G3 |
| | | | | | Plain paper | G3 | G3 | G3 | G3 | G3 | G3 | G4 | G3 | G4 |

What is claimed is:

1. A recording apparatus comprising;

an intermediate transfer member, a supply unit that supplies onto the intermediate transfer member a curable solution containing a cationic curable material that is cured by a cationic curing reaction upon application of an external stimulus, a discharge unit that discharges an ink containing a recording substance to a layer to be cured that has been formed by the curable solution supplied onto the intermediate transfer member, a transfer unit that transfers, from the intermediate transfer member to a recording medium, the layer to be cured to which the ink is discharged, and a stimulus supply unit that supplies a stimulus that cures the layer to be cured.

2. The recording apparatus according to claim 1, wherein the cationic curable material is a cationic UV curable material that is cured by a cationic curing reaction under the irradiation of UV-rays, and the stimulus supply unit is a UV irradiation unit that irradiates UV-rays to the layer to be cured.

3. The recording apparatus according to claim 1, wherein the cationic curable material is a cationic electron beam curable material that is cured by a cationic curing reaction under the irradiation of an electron beam, and the stimulus supply unit is an electron beam irradiation unit that irradiates an electron beam to the layer to be cured.

4. The recording apparatus according to claim 1, wherein the intermediate transfer member is an intermediate transfer belt.

5. The recording apparatus according to claim 1, wherein the intermediate transfer member is an intermediate transfer drum.

6. The recording apparatus according to claim 1, wherein the cationic curable material is an epoxy monomer or an oxetane monomer, and the stimulus supply unit is a UV irradiation unit.

7. The recording apparatus according to claim 1, wherein the layer to be cured that has been formed on the intermediate transfer member and has the ink discharged thereto is transferred to the recording medium in a semi-cured state.

8. The recording apparatus according to claim 1, wherein the ink is an oil-based ink.

9. The recording apparatus according to claim 8, wherein the layer to be cured contains an oil absorbing material.

10. The recording apparatus according to claim 1, wherein the ink is an aqueous ink.

11. The recording apparatus according to claim 10, wherein the layer to be cured contains a water absorbing material.

12. A recording material comprising a curable solution that (i) contains a cationic curable material that is cured by a cationic curing reaction upon application of an external stimulus, and (ii) is capable of receiving an ink containing a recording substance.

13. The recording material according to claim 12, wherein the recording material contains an oil absorbing material.

14. The recording material according to claim 12, wherein the recording material contains a water absorbing material.

15. The recording material according to claim 12, wherein the cationic curable material is an epoxy monomer or an oxetane monomer.

* * * * *